United States Patent [19]

Holmstrom

[11] Patent Number: 4,838,466

[45] Date of Patent: Jun. 13, 1989

[54] COLLAPSIBLE HOLDER FOR AEROSOL DISPENSERS

[76] Inventor: Carl A. Holmstrom, 3230 Lindsay Ave., Boise, Id. 83705

[21] Appl. No.: 153,076

[22] Filed: Feb. 8, 1988

[51] Int. Cl.[4] ..... A45C 11/00; A45C 11/38

[52] U.S. Cl. ..... 224/250; 224/148; 224/253; 224/901; 224/246; 220/85 H; 220/379

[58] Field of Search ..... 224/253, 148, 191, 242, 224/246, 250; 220/379, 85 H; 215/100.5

[56] References Cited

U.S. PATENT DOCUMENTS

| | | | |
|---|---|---|---|
| 2,013,358 | 9/1935 | Osborne | 224/148 |
| 2,524,639 | 10/1950 | Saunders | 224/250 |
| 3,297,217 | 1/1967 | Nichols | 224/246 |
| 3,813,017 | 5/1974 | Pimsleur | 224/901 |
| 4,119,249 | 10/1978 | Hanson | 224/253 |
| 4,139,130 | 2/1979 | Glusker et al. | 224/148 |
| 4,420,104 | 12/1983 | DiIenno | 224/253 |
| 4,526,280 | 7/1985 | Taylor | 215/100.5 |

*Primary Examiner*—Stephen Marcus
*Assistant Examiner*—Christine A. Peterson
*Attorney, Agent, or Firm*—Paul F. Horton

[57] ABSTRACT

A holder for fluid dispensers, of the type having a removable lid and tubular dispensing stem, to hold the lid and stem in place during periods of non-use, said holder comprising a flexible sidewall with fasteners; an elastic bottom strap; an elastic top strap with fastener; and a stem receptacle. The holder will hold dispensers of varying circumference and diameters. The stem receptacle or pocket is provided with a top opening located directly beneath the top strap so that the top strap engages the dispenser lid and covers the top opening of the receptacle to both hold the lid and stem in place upon fastening. The lid may be provided on its top surface with a fastener of hook-loop material for engaging a mating fastener on the holder to prevent loss of the lid during use of the dispenser.

10 Claims, 1 Drawing Sheet

COLLAPSIBLE HOLDER FOR AEROSOL DISPENSERS

BACKGROUND OF THE INVENTION

1. Field of the Invention

This invention relates to container holders and covers and, more particularly, to holders of fluid dispensers with tubular dispensing stems.

2. Description of the Prior Art

A common problems with aerosol dispensers having removable lids and dispensing stems is the loss of either the lid or the stem, or both. The dispensers are normally sold with the tubular stem attached to the side of the container by means of adhesive tape. In that the products dispensed often have an oil base and in that adhesive tape is seldom usable more than once, once the container becomes contaminated or once the tape loses its adherence, the tape is no longer suitable to hold the stem and the stem is therefore often misplaced. Once removed, the lid also is often misplaced in that there are often no means available for keeping the lid with the container.

While covers and carriers are known for beverage containers, such as typified by U.S. Pat. No. 4,197,890, issued to J. F. Simko and U.S. Pat. No. 4,401,245, issued to R.V. Zills, no holders are known which are used to prevent loss of stems and lids.

SUMMARY OF THE INVENTION

The present invention solves the problem by providing a fluid dispenser holder with a flexible sidewall, provided with fasteners for securely encircling dispensers of varying circumferences; an elastic bottom strap to engage the bottom of a dispenser; an elastic top strap, with fastener, to engage the lid to hold it in place; and a stem receptacle, with top opening, which is also covered by the top strap, when fastened, to prevent loss of the stem. A lid fastener, adhesively mounted to the top surface of the lid, engages a mating fastener on the holder to prevent loss of the lid during the dispensing procedure.

It is therefore a primary object of the present invention to provide a fluid dispenser holder which is operable to hold a lid on a dispenser and to hold a dispensing stem in storage during periods of non use.

More particularly, it is an object of the present invention to provide a fluid dispenser holder which includes a stem receptacle and a strap which places a downward pressure on a dispenser lid and simultaneously covers the receptacle to prevent loss of the stem, when fastened.

It is also an object of the present invention to provide a fluid dispenser holder which will accommodate dispensers of varying circumferences and diameters to hold the lid and stem in place for storage.

Another object of the present invention is to provide a holder which will hold the lid of a dispenser to the holder during periods of use.

Additional objects and advantages will become apparent and a more thorough and comprehensive understanding may be had from the following description taken in conjunction with the accompanying drawings forming a part of this specification.

DETAILED DESCRIPTION OF THE INVENTION

Figure 1:
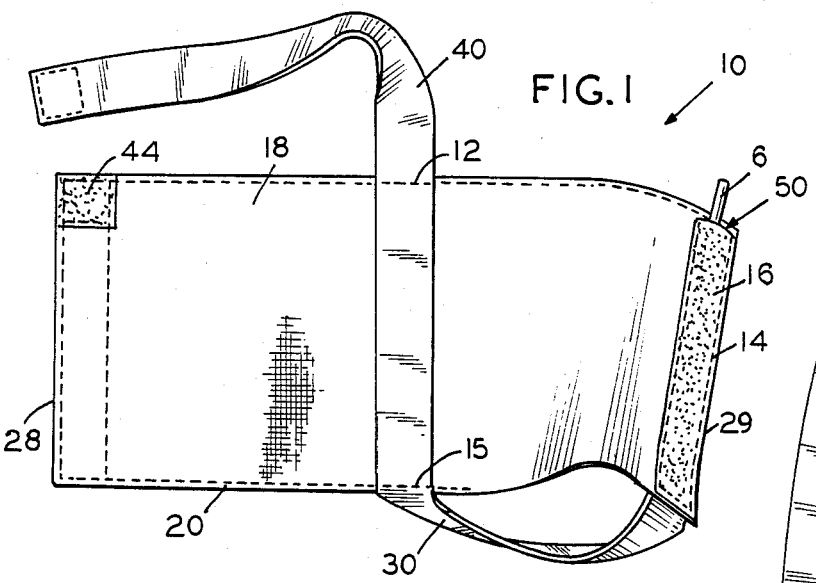
FIG. 1 is a plan view of the exterior surface of a preferred embodiment of the dispenser holder.
Figure 2:
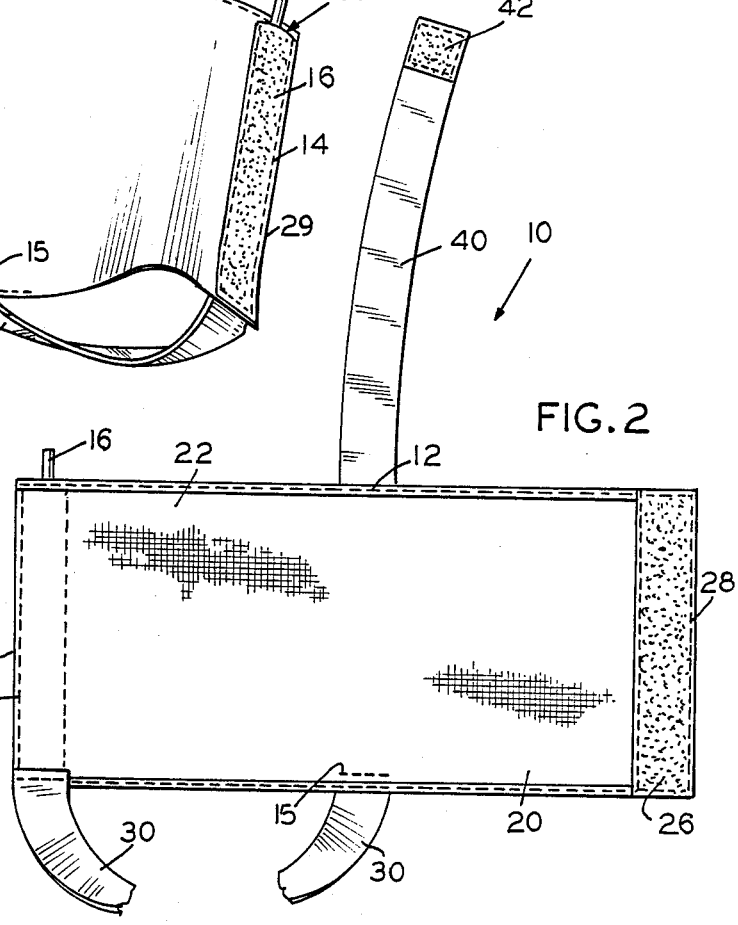
FIG. 2 is a plan view of the interior surface of the holder shown in FIG. 1.

Referring to the figures and to FIG. 1 and 2, in particular, an embodiment to be preferred of fluid dispenser holder 10 is disclosed. Holder 10 includes a sidewall 20, a bottom strap 30, a top strap 40, a stem receptacle 50, and may also include a lid fastener 60, shown in FIG. 5.

Sidewall 20 is constructed of a rectangular sheet of flexible, collapsible, and preferably water resistant material, such as nylon. It has a width sufficient in length to encircle a fluid dispenser container 7, as may be seen in FIGS. 3 and 4. In the embodiment shown, sidewall 20 has a width of nine and one-half inches and a height of four inches. On its exterior surface 18, as shown in FIG. 1, is affixed by stitching 14, sidewall fastening means in the form of a strip 16 of hook-loop material, marked under the trademark Velcro. The Velcro® strip extends the substantial height of the sidewall along one border 29 of the sidewall. On the interior surface 22, along the opposing border 28 of sidewall 20, as may be seen in FIG. 2, is a mating fastening strip 26 of Velcro® which engages strip 16 to hold the sidewall in place about the circumference of dispenser 7. Velcro® strips 16 and 26 may be of any suitable width and the strips, it is to be noted, allow the sidewall to encircle dispensers of varying circumferences.

Figure 3:
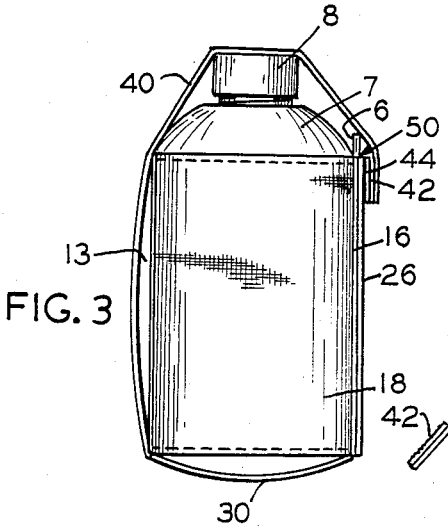
FIG. 3 is a side view of the holder shown holding a dispenser and stem in the storage mode.
Figure 4:
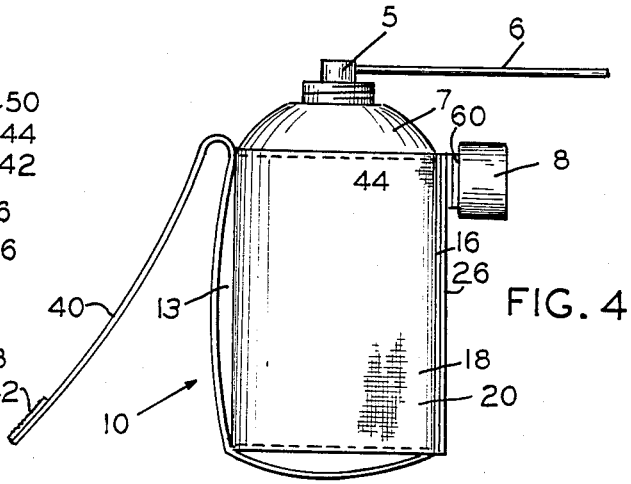
FIG. 4 is a side view of the holder shown holding a dispenser prepared for use.

Bottom strap 30 is constructed of material, at least a part of which is elastic, so that the strap may be stretched to accommodate dispensers 7 of varying diameters. The bottom strap is affixed to exterior surface 18 of sidewall 20 adjacent the middle lower edge of the sidewall, as by stitches 15, and is also attached to the interior surface 22 at the lower end of border 29, as seen in FIGS. 1 and 2. In this manner, when the sidewall is wrapped about dispenser 7, in the closed mode or position, as shown in FIGS. 3 and 4, the bottom strap engages and effectively bisects the bottom surface of the dispenser.

Top strap 40 is also constructed of material, at least a part of which is elastic, and is of sufficient length to extend over the lid 8 of dispenser 7 to be fastened to another part of the sidewall. Top strap 40 is affixed, as by stitches 12, to exterior surface 18 of sidewall 20, adjacent the middle upper edge of the sidewall. In the preferred embodiment shown, the top strap is integral with the bottom strap, extending across the height of the exterior surface of the sidewall to define a belt loop 13, between stitches 12 and 15, for attachment to the person. Top strap 40 is provided with a Velcro® fastener 42 which engages a mating Velcro® fastener 44 which is stitched onto exterior surface 18 of sidewall 20 adjacent the upper corner of border 28, as shown in FIG. 1.

Stem receptacle 50 is in the form of a pocket having a top opening. While the receptacle may be placed at any desired position on the external surface 18 of the sidewall, it is much preferred that the receptacle be placed so that the top opening is covered by top strap 40 when the top strap is in the fastened position, to prevent accidental dislodgement of the stem. For this reason, and for reasons of manufacturing efficiency, receptacle 40 is formed by stitching Velcro® strip 16 about its side and bottom edges to leave a top opening for reception of stem 6, as shown to advantage in FIGS. 1 and 3.

Figure 5:
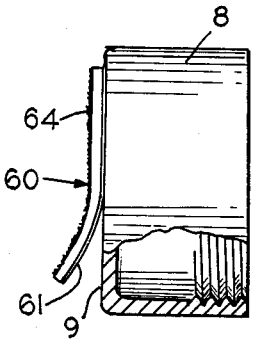
FIG. 5 is a side view of the cap fastener of the present invention, shown partially dislodged for clarity.

Referring now to FIG. 5, lid fastener 60 may be seen to advantage. Fastener 60 includes an adhesive backing 61 which adheres to the top surface 9 of lid 8 of dispenser 7 and a top surface 64 of Velcro® which matingly engages strip 44 so that the lid may be attached to holder 10 during periods of use, as shown in FIG. 4, to prevent loss of the lid.

To attach holder 10 to a dispenser 7, sidewall 20 is simply wrapped around the dispenser with the interior surface 22 of the sidewall in engagement with the dispenser and with bottom strap 30 engaging the bottom of the dispenser. During use of the dispenser, stem 6 is inserted into spray nozzle 5 of the dispenser and lid 8 is attached by means of lid fastener 60 to fastener 44, as shown in Fig. 4. After use, stem 6 is inserted into stem receptacle 50, as shown in FIG. 1; lid 8 is replaced on dispenser 7 and top strap 40 is stretched across the lid and down over the top opening of receptacle 50 and fastened by means of fasteners 42 and 44, under tension. In this manner, the lid cannot fall from the dispenser and stem 6 cannot be removed from the receptacle. Again, for use, fasteners 42 and 44 are unfastened; lid 8 attached to the holder; and stem 6 taken from the pocket and inserted into the nozzle. The holder may be carried on the person by means of belt loop 13, if desired. While the fasteners preferred and described are of hook-loop material, it is obvious that other fasteners may also be used.

Having thus described in detail a preferred embodiment of the present invention, it is to be appreciated and will be apparent to those skilled in the art that many physical changes could be made in the apparatus without altering the inventive concepts and principles embodied therein. The present embodiment is therefore to be considered in all respects as illustrative and not restrictive, the scope of the invention being indicated by the appended claims rather than by the foregoing description, and all changes which come within the meaning and range of equivalency of the claims are therefore to be embraced therein.

I claim:

1. A flexible holder for a fluid dispenser of the type having a removable lid and a tubular spray dispensing stem, said holder comprising:

a flexible, substantially rectangular sidewall comformable to the dispenser, said sidewall having an interior surface engageable with the dispenser and an opposing exterior surface, said sidewall provided with first fastening means for opening said side wall and for closing said side wall to hold said side wall in a closed dispenser engaging mode;

a bottom strap connected to opposing portions of the lower edge of said sidewall for engaging the bottom of the dispenser;

a top strap connected to opposing portions of the top edge of said sidewall for engaging the lid of said dispenser to hold said lid in place;

second fastening means for opening and closure of said top strap relative to said sidewall; and a stem receptacle mounted on the exterior surface of said sidewall, said receptacle including opposing side walls and a bottom wall and defining a top opening for insertion and removal of a detached stem.

2. The holder as described in claim 1 wherein the top opening of said stem receptacle is located directly beneath said top strap for simultaneously closing said receptacle and engaging the lid of said dispenser, upon fastening said top strap to said sidewall by said fastening means.

3. The holder as described in claim 1 wherein said bottom strap is provided with elastic material for accommodating dispensers of varying diameters.

4. The holder as described in claim 1 wherein said top strap is provided with elastic material for accommodating dispensers of varying diameters and for exerting a constant downward force on the lid of the dispenser, when fastened.

5. The holder as described in claim 4 wherein said top and bottom strap are integral with one another and wherein said strap is fastened adjacent the top and bottom edge of said sidewall to define a belt loop therebetween.

6. The holder as described in claim 1 wherein said fastening means of said sidewall includes one longitudinal strip of hook-loop material affixed to an interior border of said sidewall and a second longitudinal strip of mating hook-loop material affixed to an exterior opposing border of said sidewall and wherein said second longitudinal strip is affixed so as to define said stem receptacle.

7. The holder as described in claim 1 wherein said top strap fastening means is constructed of mating portions of hook-loop material and further comprising a dispenser lid fastener, said lid fastener having an adhesive backing for attachment to the top surface of the lid and a front surface of hook-loop material mateable with one of the portions of said hook-loop material of said top strap fastening means for temporary attachment of said lid to said strap fastening means.

8. A collapsible holder for a fluid dispenser of the type having a removable lid and a tubular spray dispensing stem, said holder comprising:

a flexible, substantially rectangular sidewall, said sidewall provided with mating hook-loop fasteners for holding said sidewall in a closed position about dispensers of varying circumferences;

a bottom strap, at least a portion of which is elastic to accommodate dispensers of varying diameters, said bottom strap connected to opposing portions of the lower edge of said sidewall for engaging the bottom of the dispenser;

a stem receptacle having a top opening, said receptacle mounted on the exterior surface of said sidewall; and a top strap, at least a portion of which is elastic, connected to the top edge of said sidewall, said top strap, on at least one end provided with a fastener of hook-loop material operable to engage a mating fastener located on said sidewall below the top opening of said stem receptacle; said top strap operable to engage the lid of said dispenser to place downward pressure on said lid for holding said lid in place and to simultaneously cover the top opening of said stem receptacle, when fastened.

9. The holder as described in claim 8 wherein one of said sidewall fasteners is in the form of a longitudinal strip affixed to an interior border of said sidewall and the other sidewall fastener is in the form of a second longitudinal strip affixed to an exterior opposing border on said sidewall so as to define a stem receptacle.

10. The holder as described in claim 8 further comprising a dispenser lid fastener having an adhesive backing for attachment of said lid fastener to the top surface of the lid and a front surface of hook-loop material, said front surface operable to engage a mating fastener on the holder for holding said lid to the holder when removed from the dispenser.

* * * * *